US005511682A

United States Patent [19]

Pace

[11] Patent Number: 5,511,682

[45] Date of Patent: Apr. 30, 1996

[54] PORTABLE ANIMAL WASTE COLLECTOR/STORAGE APPARATUS

[76] Inventor: George S. Pace, Hidden Creek, Lake Zurich, Ill. 60047

[21] Appl. No.: 386,981

[22] Filed: Dec. 19, 1994

[51] Int. Cl.[6] ..... B65D 85/00

[52] U.S. Cl. ..... 220/404; 220/908

[58] Field of Search ..... 220/505, 404, 220/908, 485, 349, 335, 407, 230; 119/165, 170

[56] References Cited

U.S. PATENT DOCUMENTS

| | | | |
|---|---|---|---|
| 2,096,578 | 10/1937 | Flanagan | 220/344 |
| 2,308,398 | 1/1943 | Stevens | 220/404 X |
| 2,613,843 | 10/1952 | Suda | 220/335 |
| 2,796,309 | 6/1957 | Taylor | 220/407 X |
| 3,370,787 | 2/1968 | Lindholm et al. | 220/404 X |
| 3,402,848 | 9/1968 | Busey | 220/404 |
| 4,440,410 | 4/1984 | Bradshaw | 220/344 X |
| 4,441,734 | 4/1984 | Schlissel | 220/485 X |
| 4,787,488 | 11/1988 | Campanini | 220/230 X |
| 4,823,979 | 4/1989 | Clark, Jr. | 220/407 |
| 4,850,508 | 7/1989 | Lee | 220/407 |
| 5,134,974 | 8/1992 | Houser | 119/165 X |
| 5,295,606 | 3/1994 | Karwoski | 220/908 X |

*Primary Examiner*—Steven M. Pollard
*Attorney, Agent, or Firm*—Emrich & Dithmar

[57] ABSTRACT

Apparatus for collecting and temporarily storing animal waste such as in the form of droppings includes a storage container mounted to wheels for portability and a pivoting cover movable between an open position and a closed position wherein a seal is established between the cover and container for confining offensive odors when the cover is in the closed position. The container is adapted to receive a removable bag which facilitates removal and disposal of the waste. A handle attached to the container facilitates manually moving the apparatus and includes a latch mechanism for securely supporting the cover in the open position, while an outer portion of the container is provided with a holder for storing spare disposal bags. A retaining arrangement is disposed on an outer surface of the storage container for engaging and maintaining the liner bag securely in position within the container. The cover is maintained in the closed position on the container by a magnetic arrangement. The apparatus is lightweight, maneuverable and conveniently stored and emptied, permitting removal and disposal of animal waste after extended periods use. Mounted to the storage container is an arrangement for attaching a hand operated, removable waste receiver, or scooper, for engaging animal waste and depositing it in the storage container.

11 Claims, 1 Drawing Sheet

PORTABLE ANIMAL WASTE COLLECTOR/STORAGE APPARATUS

FIELD OF THE INVENTION

This invention relates generally to the disposal of animal waste such as in the form of droppings and is particularly directed to a portable apparatus for collecting and temporarily storing animal waste until disposal.

BACKGROUND OF THE INVENTION

Devices for collecting and disposing of animal waste such as droppings come in various shapes and forms. Generally, these devices include an elongated, linear shaft having a handle, and sometimes an operating control, at one end and a waste engaging and collecting mechanism at the second, opposed end. By manipulating the control mechanism with the collecting mechanism disposed adjacent the droppings, the animal waste may be collected and disposed of in a sanitary manner. This type of animal waste collection device is carried by the user. Frequently the distances involved are rather lengthy such as in the case of a pet owner walking his or her dog or cat over an extended distance, or in the clearing of a large yard or open space. The latter situation may involve a large number of trips to a garbage or refuse container for deposit and disposal of the animal waste. In both situations, carrying the waste collection device is frequently burdensome, difficult and awkward.

The present invention addresses the aforementioned limitations of the prior art by providing a portable animal waste collector/storage apparatus which is lightweight and easy to use, is particularly adapted for use over extended distances as well as in the collection and disposal of large amounts of animal waste, and is clean and sanitary allowing for the temporary storage of the waste prior to disposal and deposit in a larger container.

OBJECTS AND SUMMARY OF THE INVENTION

Accordingly, it is an object of the present invention to provide for the convenient, sanitary, and non-offensive collection, storage and disposal of animal waste such as in the form of droppings.

It is another object of the present invention to provide apparatus for the collection and temporary storage of animal waste which is lightweight and portable, clean and sanitary to use, and requires emptying only after extended use.

These objects of the present invention are achieved and the disadvantages of the prior art are eliminated by apparatus for collecting and storing animal waste such as droppings, the apparatus comprising: a container including side walls and a bottom portion and having an open top portion; a cover attached to an upper portion of the container and moveable between a closed position wherein the cover is disposed over the open top portion of the container and an open position permitting deposit of animal waste in or removal of animal waste from the container; a closure arrangement disposed on the container and the cover for maintaining the cover in the closed position; a plurality of wheels attached to the container on or adjacent to the bottom portion thereof; a first handle attached to the container for manually displacing the apparatus, the handle including an upper portion for grasping by a user and a lower portion for supporting the container when the apparatus is stationary; a removable liner bag disposed within the container; a seal disposed intermediate the cover and the open top portion of the container when the cover is in the closed position for confining offensive odors to the container; a retention arrangement for engaging the liner bag and securely maintaining the liner bag within the container; and a mounting arrangement for attaching an animal waste receiving device to the apparatus.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
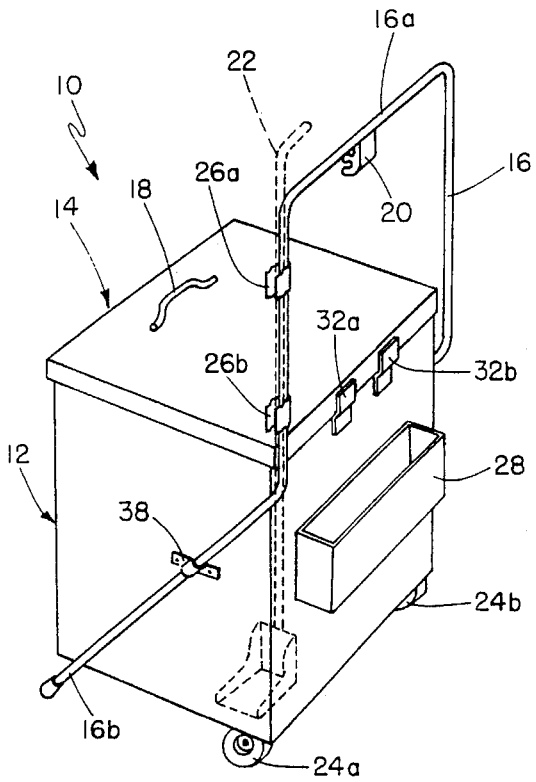
FIG. 1 is an upper perspective view of a portable animal waste collector/storage apparatus in accordance with the principles of the present invention.
Figure 2:
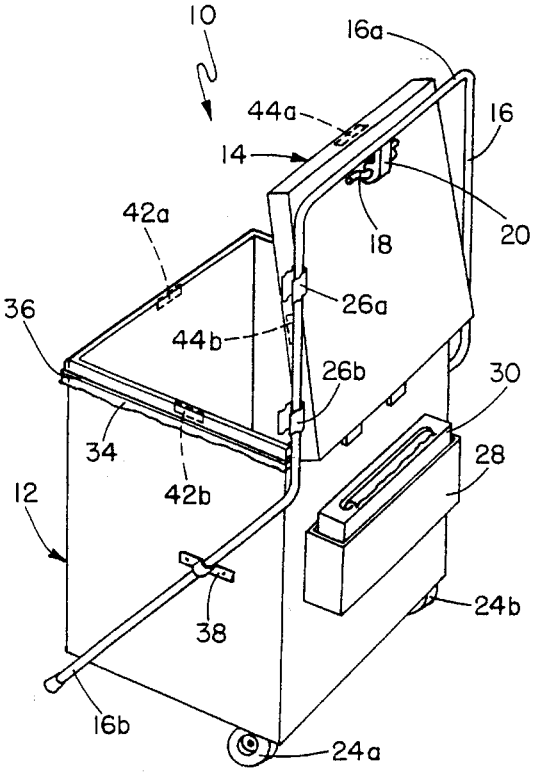
FIG. 2 is an upper perspective view of the portable animal waste collector/storage apparatus shown in FIG. 1 illustrating the cover in the open position.

Referring to FIG. 1, there is shown an upper perspective view of a portable animal waste collector/storage apparatus 10 in accordance with the principles of the present invention. FIG. 2 is a view of the portable animal waste collector/storage apparatus 10 similar to that shown in FIG. 1 illustrating the cover 14 of the apparatus in the open position. The portable animal waste collector/storage apparatus 10 includes a container 12 having bottom and side walls and an open upper portion. Attached adjacent to the open upper portion of container 12 by conventional means such as first and second hinges 32*a* and 32*b* is a cover 14. Cover 14 is adapted for pivoting displacement on the container 12 between a closed position as shown in FIG. 1 and an open position as shown in FIG. 2. The cover 14 may be maintained in the closed position on the container 12 by conventional means such as a plurality of magnets 44*a* and 44*b* in the cover and magnets 42*a* and 42*b* in an upper portion of the container as shown in FIG. 2, where the magnets are shown in dotted line form. Attached to an upper surface of cover 14 is a handle to facilitate manually lifting and lowering of the cover. Container 12 and cover 14 are preferably comprised of a lightweight material of moderate strength such as plastic or a thin sheet metal. Handle 18 may be securely affixed to the upper surface of cover 14 by conventional means such as an epoxy cement or screws (not shown for simplicity).

Attached to the outer surface of the container 12 by conventional means as such as mounting brackets 38 (only one of which is shown in the figures for simplicity) is a handle 16. An upper portion 16*a* of handle 16 is adapted for manually grasping for moving the collector/storage apparatus 10 which includes first and second wheels 24*a* and 24*b* which may be in the form of casters. A lower portion 16*b* of handle 16 provides a pair of forward legs for supporting the collector/storage apparatus 10 when not being transported by a user. Handle 16 is also comprised of a lightweight, high strength material such as plastic or metal. Handle 16 includes a latch mechanism 20 attached to its upper portion 16*a* for securely engaging the cover's handle 18 for maintaining the cover in the open position as shown in FIG. 2. Attached to a lateral portion of handle 16 are first and second retainer clips 26*a* and 26*b* for engaging a waste receiver/disposal mechanism 22 shown in FIG. 1 in dotted line form. The first and second retainer clips 26*a*, 26*b* permit the waste receiver/disposal mechanism 22 to be removed from handle 16 for engaging and depositing animal waste in container 12. Attached to an aft, outer surface of container 12 by conventional means such as an epoxy cement or screws is a receptacle 28 open at the top for receiving and supporting a container 30 storing a plurality of liner bags such as of the plastic type as shown in FIG. 2 and discussed below.

Figure 4:
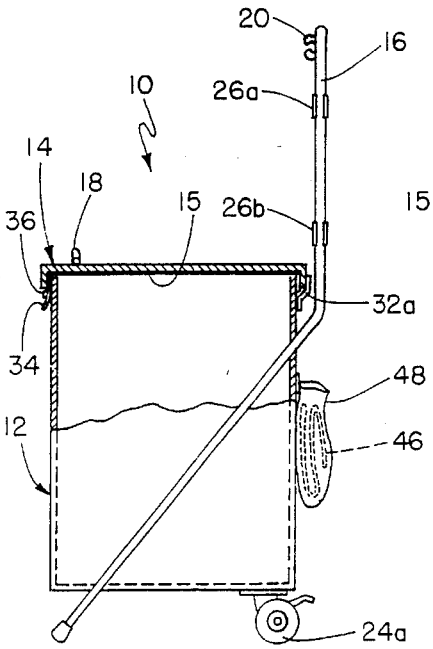
FIG. 4 is a partially cutaway side elevation view of the portable animal waste collector/storage apparatus of the present invention.
Figure 3:
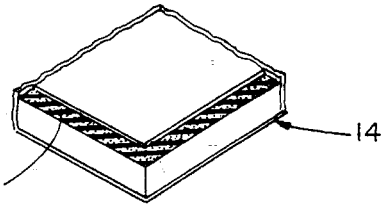
FIG. 3 is a perspective view shown partially in section of an inner corner of a cover, or lid, for use in the portable animal waste collector/storage apparatus of the present invention.

With reference to FIG. 3 which is a perspective view of an inner corner portion of the container's lid 14 and FIG. 4 which is a partially cutaway lateral elevation view of the portable animal waste collector/storage apparatus 10, additional details of the apparatus will now be described. A liner bag 34 is inserted within container 12 in a manner to permit the bag's open end, edge portion to be wrapped around the upper peripheral edge of the container. With the upper edge of liner bag 34 extending downwardly from the upper edge of container 12 and engaging the outer periphery of the container, a liner bag retainer 36 may be positioned about the container so as to engage the edge of the liner bag for maintaining the liner bag securely in position on the container. The liner bag retainer 36 is preferably comprised of a stretchable material such as rubber which may be reused following disposal of the liner bag 34 and its contents. The liner bag 34 itself may be comprised of any of the more common materials such as a plastic bag with a draw string.

Disposed on the inner surface of cover 14 and extending about the inner periphery thereof is a seal 15. Seal 15 contacts the upper edge of the liner bag 34 and engages the upper edge of the container 12 when the cover 14 is in the closed position as shown in the partially cutaway side elevation view of FIG. 4. Inner seal 15 is preferably comprised of a resilient, compressible material such as rubber or plastic for engaging the liner bag and container combination and establishing a good seal therebetween for preventing the escape of offensive odors from the container with animal waste disposed therein. Inner seal 15 thus permits the portable animal waste collector/storage apparatus 10 to be used for extended periods of time without requiring frequent emptying of the apparatus of the animal waste deposited therein. Inner seal 15 may be affixed to the inner surface of cover 14 by conventional means such as an epoxy cement (not shown in the figures for simplicity). Also as shown in FIG. 4, the portable animal waste collector/storage container 10 may be provided with another arrangement for holding spare liner bags 46 (shown in dotted line form) in the form of a pouch or vinyl bag 48. Pouch 48 may be attached to a lateral portion of container 12 by conventional means such as an epoxy cement or threaded fasteners which are not shown in the figure for simplicity.

Figure 5:
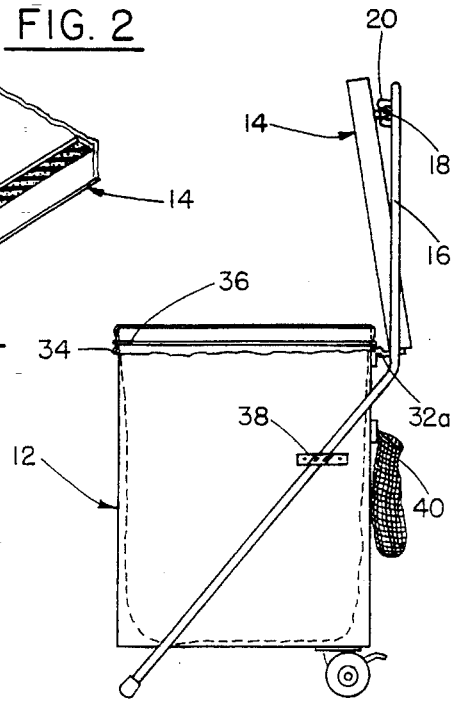
FIG. 5 is a side elevation view shown partially in phantom of the inventive portable animal waste collector/storage apparatus illustrating the cover in the open position, where the apparatus includes a bag-like spare disposal bag container.

Referring to FIG. 5, there is shown another embodiment of the portable animal waste collector/storage apparatus 10 having a liner bag holder 40 in the form of an elastic bag attached to the outer, aft surface of container 12. Liner bag holder 40 is adapted to securely retain and store a plurality of liner bags prior to use by inserting a bag within container 12. Liner bag 34, shown partially in dotted line form in FIG. 5, extends down into and occupies substantially the full space defined by container 12.

There has thus been shown portable apparatus for the collection and storage of animal waste which includes a container with a cover including means for establishing a tight seal between the container and cover for confining offensive odors. The container is lined with a disposable bag securely maintained in position by means of a bag retaining band disposed about an upper edge of the container. The apparatus is lightweight and portable, includes on wheels or casters, and has a handle which provides support for the apparatus when stationary, facilitates manual maneuvering of the apparatus by a user, and is adapted to receive and support a hand-operated animal waste receiver/disposal mechanism. Attached to the container is an extra liner bag holder or receptacle.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. Apparatus for collecting and storing animal waste such as droppings, said apparatus comprising:

a container including side walls and a bottom portion and having an open top portion;

a cover attached to an upper portion of said container and moveable between a closed position wherein said cover is disposed over the open top portion of said container and an open position permitting deposit of animal waste in or removal of animal waste from said container;

hinge means coupling said cover to said back wall at the upper portion of said container to permit said cover to move between said closed position and said open position in a pivoting manner;

closure means disposed on said container and said cover for maintaining said cover in the closed position;

a plurality of wheels attached to said container on or adjacent to said back wall at the bottom portion thereof;

a first handle attached to said container for manually displacing said apparatus, said handle including a generally inverted U-shaped upper portion extending upwardly from the back wall of said container for grasping by a user, an intermediate portion extending downwardly from said upper portion and diagonally across said end walls, and a lower portion extending downwardly from said front wall, to below said bottom portion for supporting said container when said apparatus is stationary;

a removable liner bag disposed within said container;

a seal disposed intermediate said cover and the open top portion of said container when said cover is in said closed position for confining offensive odors to said container;

retention means for engaging said liner bag and securely maintaining said liner bag within said container; and mounting means for attaching an animal waste receiving device to said apparatus.

2. The apparatus of claim 1 wherein said seal is attached to a lower surface of said cover and is disposed about the entire open top portion of said container when said cover is closed.

3. The apparatus of claim 2 wherein said seal is comprised of a compressible, resilient material.

4. The apparatus of claim 3 wherein said compressible, resilient material is rubber or plastic.

5. The apparatus of claim 1 wherein said retention means for engaging said liner bag includes an elastic member disposed about said container and urging said bag liner in secure engagement with said container.

6. The apparatus of claim 1 further comprising retaining means attached to said apparatus for holding a plurality of spare liner bags.

7. The apparatus of claim 6 wherein said retaining means comprises a box-like retainer attached to said container.

8. The apparatus of claim 6 wherein said retaining means comprises a mesh bag holder attached to said container.

9. The apparatus of claim 1 wherein each of said wheels includes a pivoting caster structure.

10. The apparatus of claim 1 further comprising a second handle attached to said cover and a latch mechanism attached to said first handle for engaging said second handle and maintaining said cover in said open position.

11. The apparatus of claim 1 wherein said closure means includes a magnet.

* * * * *